US009415271B2

(12) United States Patent
Kimura et al.

(10) Patent No.: US 9,415,271 B2
(45) Date of Patent: Aug. 16, 2016

(54) MULTI-PIECE SOLID GOLF BALL

(71) Applicant: Bridgestone Sports Co., Ltd., Tokyo (JP)

(72) Inventors: Akira Kimura, Chichibushi (JP); Toru Ogawana, Chichibushi (JP); Junji Hayashi, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 14/712,302

(22) Filed: May 14, 2015

(65) Prior Publication Data

US 2015/0367178 A1 Dec. 24, 2015

(30) Foreign Application Priority Data

Jun. 24, 2014 (JP) ..... 2014-129048

(51) Int. Cl.
*A63B 37/02* (2006.01)
*A63B 37/00* (2006.01)

(52) U.S. Cl.
CPC ..... *A63B 37/0063* (2013.01); *A63B 37/0027* (2013.01); *A63B 37/0039* (2013.01); *A63B 37/0043* (2013.01); *A63B 37/0051* (2013.01); *A63B 37/0058* (2013.01); *A63B 37/0076* (2013.01); *A63B 37/0092* (2013.01)

(58) Field of Classification Search
CPC ..... A63B 37/0076; A63B 37/0051
See application file for complete search history.

(56) References Cited

U.S. PATENT DOCUMENTS

| | | | | |
|---|---|---|---|---|
| 6,071,201 | A | 6/2000 | Maruko | |
| 6,248,027 | B1 * | 6/2001 | Hayashi | A63B 37/0003 473/371 |
| 6,254,495 | B1 | 7/2001 | Nakamura et al. | |
| 6,271,296 | B1 | 8/2001 | Nakamura et al. | |
| 6,394,912 | B1 | 5/2002 | Nakamura et al. | |
| 6,431,998 | B1 | 8/2002 | Nakamura et al. | |
| 6,461,251 | B1 * | 10/2002 | Yamagishi | A63B 37/0003 473/376 |
| 6,605,009 | B1 | 8/2003 | Nakamura et al. | |
| 6,688,991 | B2 | 2/2004 | Sullivan et al. | |
| 6,756,436 | B2 | 6/2004 | Rajagopalan et al. | |
| 6,824,477 | B2 | 11/2004 | Rajagopalan et al. | |
| 6,894,098 | B2 | 5/2005 | Rajagopalan et al. | |
| 6,939,907 | B2 | 9/2005 | Rajagopalan et al. | |
| 6,962,539 | B2 | 11/2005 | Sullivan et al. | |
| 6,988,962 | B2 | 1/2006 | Sullivan et al. | |
| 7,041,009 | B2 | 5/2006 | Sullivan et al. | |
| 7,125,348 | B2 | 10/2006 | Sullivan et al. | |
| 7,157,512 | B2 | 1/2007 | Rajagopalan et al. | |
| 7,230,045 | B2 | 6/2007 | Rajagopalan et al. | |

(Continued)

FOREIGN PATENT DOCUMENTS

| | | |
|---|---|---|
| JP | 201 1-1 36021 A | 7/2011 |
| JP | 201 1-21 7857 A | 11/2011 |

(Continued)

*Primary Examiner* — John E Simms, Jr.
(74) *Attorney, Agent, or Firm* — Sughrue Mion, PLLC

(57) ABSTRACT

In a multi-piece solid golf ball having a core formed of a center core encased by an envelope layer, a cover having a plurality of dimples on its surface, and one or more intermediate layer disposed between the core and the cover, the center core and the envelope layer are each made of an elastic material, the radius r (mm) of the center core satisfies the condition 5≤r≤15, and the core has a cross-sectional hardness profile that satisfies specific conditions. This golf ball has an increased distance and a soft feel at impact, and also is able to prevent a decline in the durability to cracking.

16 Claims, 1 Drawing Sheet

(56) References Cited

U.S. PATENT DOCUMENTS

| | | | | |
|---|---|---|---|---|
| 7,285,059 | B2 * | 10/2007 | Sullivan | A63B 37/0003 473/376 |
| 7,641,571 | B2 | 1/2010 | Hebert et al. | |
| 7,648,427 | B2 | 1/2010 | Isogawa | |
| 7,652,086 | B2 | 1/2010 | Sullivan et al. | |
| 2009/0111610 | A1 * | 4/2009 | Watanabe | A63B 37/0004 473/373 |
| 2010/0160087 | A1 * | 6/2010 | Nakamura | A63B 37/0003 473/375 |
| 2011/0045923 | A1 * | 2/2011 | Umezawa | A63B 37/0051 473/373 |
| 2011/0159998 | A1 | 6/2011 | Ohama et al. | |
| 2011/0250991 | A1 | 10/2011 | Isogawa et al. | |
| 2012/0043686 | A1 | 2/2012 | Ichikawa et al. | |
| 2012/0046127 | A1 * | 2/2012 | Ichikawa | A63B 37/0003 473/376 |
| 2013/0029786 | A1 * | 1/2013 | Ishii | A63B 37/0003 473/373 |
| 2013/0090188 | A1 * | 4/2013 | Okabe | A63B 37/0075 473/377 |
| 2013/0296075 | A1 | 11/2013 | Kimura et al. | |
| 2013/0296076 | A1 | 11/2013 | Kimura et al. | |
| 2013/0296077 | A1 | 11/2013 | Kimura et al. | |
| 2014/0018191 | A1 | 1/2014 | Watanabe et al. | |
| 2014/0100059 | A1 | 4/2014 | Kimura et al. | |

FOREIGN PATENT DOCUMENTS

| | | | |
|---|---|---|---|
| JP | 2012-040376 | A | 3/2012 |
| JP | 2012-045382 | A | 3/2012 |
| JP | 2013-230361 | A | 11/2013 |
| JP | 2013-230362 | A | 11/2013 |
| JP | 2013-230363 | A | 11/2013 |

* cited by examiner

MULTI-PIECE SOLID GOLF BALL

CROSS-REFERENCE TO RELATED APPLICATION

This non-provisional application claims priority under 35 U.S.C. §119(a) on Patent Application No. 2014-129048 filed in Japan on Jun. 24, 2014, the entire contents of which are hereby incorporated by reference.

BACKGROUND OF THE INVENTION

1. Field of the Invention

The present invention relates to a multi-piece solid golf ball having a core composed of a center core encased by an envelope layer and, formed over the core, an intermediate layer and a cover.

2. Prior Art

To increase the distance traveled by a golf ball and also improve the feel of the ball when played, innovations have hitherto been made which involve providing the golf ball with a multilayer structure. Various golf balls with multilayer structures of three or more layers have subsequently been proposed in order to achieve a lower spin rate and a higher initial velocity and to further improve the feel at impact.

Today, golf balls having a somewhat soft cover, an intermediate layer formed of an ionomer material that is relatively hard compared with the cover, and a solid core with a one-layer or two-layer-construction that is formed of a rubber material are widely used by professional golfers and skilled amateur golfers as golf balls endowed with excellent flight performance and controllability. Such balls, owing to the somewhat soft cover, exhibit a high controllability in the short game. By combining such a cover with, on the inside thereof, a layer made of a hard, high-resilience ionomer material, the ball suppresses excessive spin on full shots with a driver and also achieves a high rebound.

Such golf balls have been disclosed in, for example, U.S. Pat. Nos. 6,071,201, 6,254,495, 6,271,296, 6,394,912, 6,431,998, 6,605,009, 6,688,991, 6,756,436, 6,824,477, 6,894,098, 6,939,907, 6,962,539, 6,988,962, 7,041,009, 7,125,348, 7,157,512, 7,230,045, 7,285,059, 7,641,571 and 7,652,086, JP-A 2012-40376, JP-A 2012-45382 and U.S. Pat. No. 7,648,427.

Hence, there is a strong demand among professional golfers and skilled amateurs for golf balls which are capable of exhibiting a level of performance in keeping with one's own skill level. Accordingly, developing golf balls having a flight performance, controllability, feel at impact and durability that are capable of satisfying a greater number of golfers, is important for expanding the golfer base.

In addition, U.S. Published Patent Application Nos. 2014/0018191 and 2014/0100059, JP-A 2013-230361, JP-A 2013-230362, JP-A 2013-230363, JP-A 2011-217857 and JP-A 2011-136021 describe various art specifying the core cross-sectional hardness profile in multi-piece solid golf balls. However, there has existed a desire for novel art which optimizes overall such parameters as the core hardness and the thickness, hardness and material of the intermediate layer so as to further improve the performance of these golf balls.

It is therefore an object of this invention to provide a multi-piece solid golf ball which has an increased distance and a soft feel at impact, and is also able to prevent a decline in the durability to cracking.

SUMMARY OF THE INVENTION

We have discovered that, in a multi-piece solid golf ball having a core formed of a center core encased by an envelope layer, a cover with a plurality of dimples on its surface, and one or more intermediate layer disposed between the core and the cover, by having the center core and envelope layer each made of an elastic material, having the radius r (mm) of the center core satisfy the condition $5 \le r \le 15$, and specifying the cross-sectional hardness (JIS-C hardness) of the core as set forth in conditions (1) to (4) below, the distance is increased, a soft feel at impact is obtained, and a decline in the durability to cracking can be prevented.

(1) The hardness difference between the core center and any point located up to (r−2) mm from the core center is 2 or less.

(2) The hardness at a point located (r+1) mm from the core center and the hardness $H_{r-1}$ at a point located (r−1) mm from the core center satisfy the relationship $10 \le H_{r+1} - H_{r-1} \le 35$.

(3) The hardness $H_{R-2}$ at a point located 2 mm inside of the core surface and the hardness $H_{r+1}$ at a point located (r+1) mm from the core center satisfy the relationship $0 \le H_{R-2} - H_{r+1} \le 7$.

(4) The difference between the core surface hardness ($H_R$) and the core center hardness ($H_0$) satisfies the relationship $20 \le H_R - H_0 \le 40$.

Accordingly, the invention provides a multi-piece solid golf ball having a core formed of a center core encased by an envelope layer, a cover with a plurality of dimples on its surface, and one or more intermediate layer disposed between the core and the cover. In this golf ball, the center core and the envelope layer are each made of an elastic material, the radius r (mm) of the center core satisfies the condition $5 \le r \le 15$, and the cross-sectional hardness (JIS-C hardness) of the core satisfies the following conditions:

(1) the hardness difference between the core center and any point located up to (r−2) mm from the core center is 2 or less;

(2) the hardness $H_{r+1}$ at a point located (r+1) mm from the core center and the hardness $H_{r-1}$ at a point located (r−1) mm from the core center satisfy the relationship $10 \le H_{r+1} - H_{r-1} \le 35$;

(3) the hardness $H_{R-2}$ at a point located 2 mm inside of the core surface and the hardness $H_{r+1}$ at a point located (r+1) mm from the core center satisfy the relationship $0 \le H_{R-2} - H_{r-1} \le 7$;

(4) the difference between the core surface hardness ($H_R$) and the core center hardness ($H_0$) satisfies the relationship $20 \le H_R - H_0 \le 40$.

In a preferred embodiment of the multi-piece solid golf ball of the invention, the center core is composed primarily of a thermoplastic elastomer and the envelope layer is composed primarily of a rubber composition. In this preferred embodiment, the center core is typically composed primarily of a thermoplastic polyester elastomer or a thermoplastic polyurethane elastomer.

In another preferred embodiment of the multi-piece solid golf ball of the invention, the core center hardness ($H_0$) satisfies the condition $50 \le H_0 \le 70$.

In yet another preferred embodiment, letting $T_i$ be the thickness (mm) of the intermediate layer and $H_i$ be the material hardness (Shore D) of the intermediate layer, the multi-piece solid golf ball of the invention satisfies the relationship $80 \le T_i \times H_i \le 200$.

In a further preferred embodiment of the multi-piece solid golf ball of the invention, the intermediate layer is formed of a plurality of N layers and, letting $T_i1$ and $H_i1$ be respectively the thickness (mm) and the material hardness (Shore D) of the first intermediate layer, $T_i2$ and $H_i2$ be respectively the thickness (mm) and the material hardness (Shore D) of the second intermediate layer and $T_iN$ and $H_iN$ be respectively the thickness (mm) and the material hardness (Shore D) of the Nth intermediate layer, the sum of the products of the thickness and the material hardness for the respective layers from the first to the Nth layer satisfies the following condition:

$$100 \leq (T_i1 \times H_i1) + (T_i2 \times H_i2) + \ldots (T_iN \times H_iN) \leq 180.$$

In a still further preferred embodiment of the multi-piece solid golf ball of the invention, the intermediate layer is composed primarily of a thermoplastic resin. In this preferred embodiment, the intermediate layer may be formed of a plurality of layers, of which at least a pair of mutually adjoining layers are made of the same type of thermoplastic resin. The thermoplastic resin of which the intermediate layer is primarily composed may be an ionomer.

In another preferred embodiment of the multi-piece solid golf ball of the invention, the cover is composed primarily of a thermoplastic resin or a thermoset resin. In this preferred embodiment, the cover may be composed primarily of a material selected from the group consisting of ionomers, polyurethanes and polyureas.

In yet another preferred embodiment, the multi-piece solid golf ball of the invention, letting the surface hardness (JIS-C hardness) of the ball be $H_b$, satisfies the condition $60 \leq H_b \leq 100$.

The multi-piece solid golf ball of the invention has an excellent flight performance on full shots with a driver (W#1) and a soft feel at impact, and also is able to prevent a decline in the durability to cracking.

BRIEF DESCRIPTION OF THE DIAGRAMS

DETAILED DESCRIPTION OF THE INVENTION

The objects, features and advantages of the invention will become more apparent from the following detailed description, taken in conjunction with the foregoing diagrams.

Figure 1:
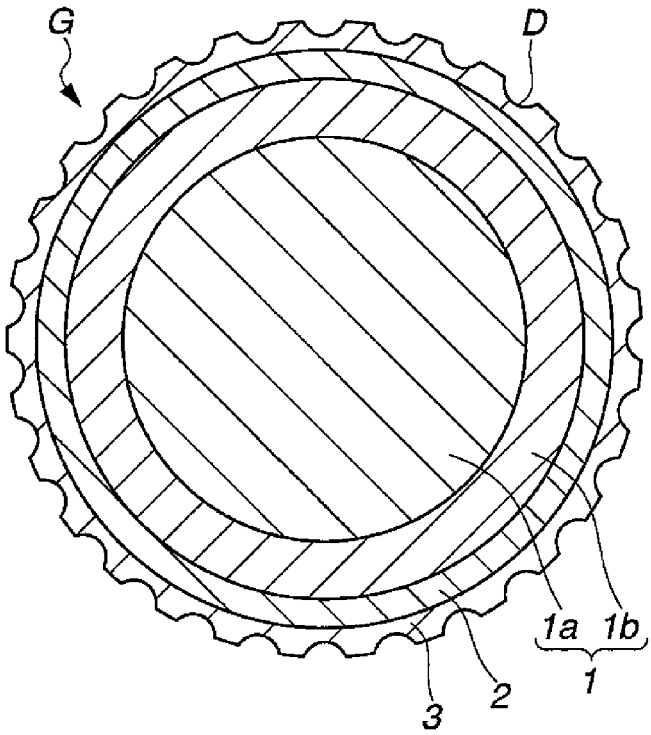
FIG. 1 is a schematic cross-sectional diagram showing the structure of the multi-piece solid golf ball of the invention.

The multi-piece solid golf ball of the invention has a core formed of a center core encased by an envelope layer, a cover with a plurality of dimples on its surface, and one or more intermediate layer disposed between the core and the cover. FIG. 1 shows an example of the cross-sectional structure of the inventive golf ball. The golf ball G in the diagram has a four-layer construction with a center core 1*a*, an envelope layer 1*b* encasing the center core, an intermediate layer 2 encasing the envelope layer, and a cover 3 encasing the intermediate layer. In addition, the ball surface has numerous dimples D thereon. Each of these layers is described in detail below.

First, as noted above, the core in this invention is formed of a center core and an envelope layer. It is critical for the center core to have a radius r that is at least 5 mm and not more than 15 mm. The lower limit in this radius r is preferably at least 8 mm, and more preferably at least 10 mm. The upper limit is preferably not more than 14 mm and more preferably not more than 12 mm. If the radius of the center core is too small, the spin rate becomes too high on full shots, as a result of which a good distance is not achieved. On the other hand, if the radius is too large, the durability of the ball upon repeated impact worsens, the feel at impact hardens, and the resilience of the ball as a whole (referred to below as the "ball rebound") is inadequate, as a result of which a good distance is not achieved.

The center core has a material hardness expressed in terms of Shore D hardness which, although not particularly limited, may be set to preferably at least 10, more preferably at least 20, and even more preferably at least 27. The upper limit in the Shore D hardness likewise is not particularly limited, but may be set to preferably not more than 50, more preferably not more than 47, and even more preferably not more than 40. If the material hardness is too low, the resilience may become too low, resulting in a poor distance, the feel at impact may become too hard, and the durability to cracking on repeated impact may worsen. On the other hand, if the material hardness is too high, the spin rate may rise excessively, as a result of which a good distance may not be achieved, and the feel at impact may become too hard.

The center core is made of an elastic material and, particularly from the standpoint of achieving a high resilience and an excellent flight performance, is preferably formed primarily of one, two or more thermoplastic elastomers selected from the group consisting of polyester, polyamide, polyurethane, olefin and styrene-type thermoplastic elastomers. A commercial product may be used as the thermoplastic elastomer. Illustrative examples include, polyester-type thermoplastic elastomers such as Hytrel (DuPont-Toray Co., Ltd.), polyamide-type thermoplastic elastomers such as Pebax (Toray Industries, Inc.), polyurethane-type thermoplastic elastomers such as Pandex (DIC Bayer Polymer, Ltd.), olefin-type thermoplastic elastomers such as Santoprene (Monsanto Chemical Co.), and styrene-type thermoplastic elastomers such as Tuftec (Asahi Chemical Industry Co., Ltd.).

In this invention, from the standpoint of moldability and resilience, the use of a polyester-type thermoplastic elastomer is preferred, with the use of a polyether ester elastomer being especially preferred. Examples of such commercially available polyether ester elastomers include Hytrel 3046 and Hytrel 4047, both from DuPont-Toray Co., Ltd. In this invention, preferred use can also be made of thermoplastic polyurethane-type elastomers. Commercially available thermoplastic polyurethane-type elastomers that may be used include Pandex, from DIC Bayer Polymer, Ltd.

A filler may be added to the center core in order to adjust the specific gravity and increase durability. In addition, where necessary, various additives may be included in the center core-forming material. For example, pigments, dispersants, antioxidants, light stabilizers, ultraviolet absorbers and mold release agents may be suitably included.

The center core has a specific gravity which, although not particularly limited, may be set to preferably more than 0.90, more preferably at least 1.00, and even more preferably at least 1.05. Although there is no particular upper limit on the specific gravity of the center core, this may be set to preferably less than 1.30, more preferably not more than 1.25, and even more preferably not more than 1.20. If the specific gravity is too large, the resilience of the center core may decrease, as a result of which a good distance may not be achieved. On the other hand, if the specific gravity is too small, the resilience may decrease and the durability of the ball to repeated impact may worsen.

No particular limitation is imposed on the method of forming the center core, although use may be made of a known method such as injection molding. Preferred use can be made of a method in which a given material is injected into the cavity of a center core-forming mold.

Next, the envelope layer is described. The envelope layer is a layer formed over the center core.

The envelope layer has a thickness which, although not subject to any particular limitation, may be set to preferably at least 3 mm, more preferably at least 4 mm, and even more preferably at least 5 mm. Although there is no particular upper limit on the thickness of the envelope layer, the thickness is preferably not more than 10 mm, more preferably not more than 9 mm, and even more preferably not more than 8 mm. If the envelope layer is too thin, the resilience may decrease, as a result of which a good distance may not be achieved, and the durability to cracking on repeated impact may worsen. On the other hand, if the envelope layer is too thick, the spin rate-lowering effect on full shots may be inadequate, as a result of which a good distance may not be achieved, and the feel of the ball on full shots may become too hard.

The overall core formed of the above center core and the envelope layer has a diameter which, although not particularly limited, may be set to preferably at least 30 mm, more preferably at least 34 mm, and even more preferably at least 35 mm. Although there is no particular upper limit on the diameter of the overall core, the diameter is preferably not more than 40 mm, and more preferably not more than 39 mm. If the diameter of the overall core falls outside of the above range, the ball may be too receptive to spin on full shots, as a result of which a good distance may not be obtained.

The envelope layer is made of an elastic material, and is preferably formed using a rubber composition. Particularly from the standpoint of obtaining a high resilience and an excellent flight performance, the envelope layer in this invention is preferably formed using a rubber composition containing the subsequently described polybutadiene as the base rubber.

The polybutadiene is not subject to any particular limitation, although the use of a polybutadiene having on the polymer chain a cis-1,4 bond content of at least 90 wt %, and preferably at least 95 wt %, is recommended. If the cis-1,4 bond content among the bonds on the molecule is too low, the rebound may decrease.

Although not subject to any particular limitation, from the standpoint of enhancing resilience, it is recommended that the content of the above polybutadiene in the base rubber be preferably at least 70 wt %, more preferably at least 80 wt %, and even more preferably at least 90 wt %.

Rubbers other than the above polybutadiene may also be included, provided that the objects of the invention are attainable. Illustrative examples include polybutadiene rubbers other than the above-described polybutadiene, styrene-butadiene rubbers, natural rubbers, isoprene rubbers and ethylene-propylene-diene rubbers. These may be used singly or as a combination of two or more types.

Additives such as the subsequently described co-crosslinking agents, organic peroxides, antioxidants, inert fillers and organosulfur compounds may be suitably blended with the above base rubber.

Illustrative examples of co-crosslinking agents include unsaturated carboxylic acids and metal salts of unsaturated carboxylic acids.

Suitable unsaturated carboxylic acids include, but are not particularly limited to, acrylic acid, methacrylic acid, maleic acid and fumaric acid. The use of acrylic acid or methacrylic acid is especially preferred.

Suitable metal salts of unsaturated carboxylic acids include, but are not particularly limited to, the above unsaturated carboxylic acids neutralized with a desired metal ion. Specific examples include the zinc salts and magnesium salts of methacrylic acid and acrylic acid. The use of zinc acrylate is especially preferred.

The amount of the co-crosslinking agent included in the rubber composition, although not particularly limited, may be set to preferably at least 10 parts by weight, more preferably at least 20 parts by weight, and even more preferably at least 30 parts by weight, per 100 parts by weight of the base rubber. There is no particular upper limit in the amount of the co-crosslinking agent included, although this amount may be set to preferably not more than 60 parts by weight, more preferably not more than 50 parts by weight, and even more preferably not more than 45 parts by weight. Too much co-crosslinking agent may give the ball a feel at impact that is too hard. On the other hand, too little co-crosslinking agent may lower the rebound.

Commercially available products may be used as the organic peroxide in the rubber composition. For example, preferred use may be made of Percumyl D, Perhexa C-40, Perhexa 3M (all produced by NOF Corporation) or Luperco 231XL (Atochem Co.). These may be used singly or as a combination of two or more thereof.

The amount of organic peroxide included in the rubber composition, although not particularly limited, may be set to preferably at least 0.1 part by weight, more preferably at least 0.3 part by weight, even more preferably at least 0.5 part by weight, and most preferably at least 0.7 part by weight, per 100 parts by weight of the base rubber. There is no particular upper limit on the amount of organic peroxide included, although this amount may be set to preferably not more than 5 parts by weight, more preferably not more than 4 parts by weight, even more preferably not more than 3 parts by weight, and most preferably not more than 2 parts by weight. Too much or too little organic peroxide may make it impossible to obtain a good feel at impact, durability and rebound.

Commercially available products may be used as the antioxidant in the rubber composition. Illustrative examples include Nocrac NS-6 and Nocrac NS-30 (both available from Ouchi Shinko Chemical Industry Co., Ltd.), and Yoshinox 425 (Yoshitomi Pharmaceutical Industries, Ltd.). These may be used singly, or two or more may be used in combination.

The amount of antioxidant included in the rubber composition can be set to more than 0, and may be set to preferably at least 0.05 part by weight, and more preferably at least 0.1 part by weight, per 100 parts by weight of the base rubber. There is no particular upper limit in the amount of antioxidant included, although this amount may be set to preferably not more than 3 parts by weight, more preferably not more than 2 parts by weight, even more preferably not more than 1 part by weight, and most preferably not more than 0.5 part by weight. Too much or too little antioxidant may make it impossible to obtain a good rebound and durability.

Preferred use may be made of inert fillers such as zinc oxide, barium sulfate and calcium carbonate in the rubber composition. These may be used singly, or two or more may be used in combination.

The amount of inert filler included in the rubber composition, although not subject to any particular limitation, may be set to preferably at least 1 part by weight, and more preferably at least 5 parts by weight, per 100 parts by weight of the base rubber. There is no particular upper limit in the amount of inert filler included, although this amount may be set to preferably not more than 50 parts by weight, more preferably not more than 40 parts by weight, and even more preferably not more than 30 parts by weight. Too much or too little inorganic filler may make it impossible to achieve a suitable weight and a good rebound.

In addition, to enhance the rebound of the golf ball, it is preferable for the rubber composition to include an organosulfur compound. The organosulfur compound is not subject to any particular limitation, provided it is capable of enhancing the golf ball rebound. Preferred use may be made of thiophenols, thionaphthols, halogenated thiophenols, and metal salts of these. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, and diphenylpolysulfides, dibenzylpolysulfides, dibenzoylpolysulfides, dibenzothiazoylpolysulfides and dithiobenzoylpolysulfides having 2 to 4 sulfurs. In this invention, of the above, the use of diphenyldisulfide or the zinc salt of pentachlorothiophenol is especially preferred.

The amount of the organosulfur compound included per 100 parts by weight of the base rubber, although not subject to any particular limitation, may be set to preferably at least 0.05 part by weight, and more preferably at least 0.1 part by weight. There is no upper limit in the amount of organosulfur compound included, although this amount may be set to preferably not more than 5 parts by weight, more preferably not more than 3 parts by weight, and even more preferably not more than 2.5 parts by weight, per 100 parts by weight of the base rubber. Including too little may make it impossible to obtain a sufficient rebound-enhancing effect. On the other hand, if too much is included, the rebound-enhancing effect (particularly on shots with a W#1) reaches a peak beyond which no further effect can be expected, in addition to which the core may become too soft, possibly worsening the feel of the ball at impact.

The specific gravity of the envelope layer, although not subject to any particular limitation, may be set to preferably not more than 1.35, more preferably not more than 1.30, and even more preferably not more than 1.25. Although there is no particular lower limit on the specific gravity, this may be set to preferably at least 1.0, more preferably at least 1.10, and even more preferably at least 1.15. If the specific gravity is too large, the rebound may decrease, as a result of which a good distance may not be achieved. If the specific gravity is too small, achieving the intended hardness becomes difficult; also, the rebound may decrease, as a result of which a good distance may not be achieved.

The envelope layer forming method may be a known method and is not subject to any particular limitation, although preferred use may be made of the following method. First, an envelope layer-forming material is placed in a given mold and subjected to primary vulcanization (semi-vulcanization) so as to produce a pair of hemispherical half-cups. Then, a prefabricated center core is enclosed within the half-cups produced as just described, and secondary vulcanization (complete vulcanization) is carried out in this state. That is, advantageous use may be made of a process in which the vulcanization step is divided into two stages. Alternatively, advantageous use may be made of a process in which the envelope layer-forming material is injection-molded over the center core.

The hardness profile of the core in this invention is explained below.

In the practice of the invention, it is critical for the cross-sectional hardness (JIS-C hardness) of the core (that is, the center core+the envelope layer) to satisfy conditions (1) to (4) below.

Condition (1) is that the hardness difference between the core center and any point located up to (r−2) mm from the core center, expressed in terms of the JIS-C hardness, be 2 or less. In a core that has been set to this condition (1), the hardness slope near the core center becomes substantially flat, achieving a sufficient spin rate-lowering effect on full shots, in addition to which a soft feel at impact and a good durability to cracking are also obtained. This hardness difference, expressed in terms of the JIS-C hardness, is preferably not more than 1.5, and more preferably not more than 1. If the upper limit in the hardness difference of condition (1) is exceeded, a sufficient spin rate-lowering effect is not obtained and the desired distance is not achieved.

Here, the center of the core has a hardness ($H_0$) which, although not particularly limited, may be set to, in terms of JIS-C hardness, preferably at least 50, more preferably at least 52, and even more preferably at least 55. There is no particular upper limit in the center hardness, although this may be set to, in terms of JIS-C hardness, preferably not more than 70, more preferably not more than 68, and even more preferably not more than 65. If the center hardness is too low, the resilience may become so low that a good distance is not achieved, the feel at impact may become too soft, and the durability to cracking under repeated impact may worsen. On the other hand, if the center hardness is too high, the spin rate may rise excessively so that a good distance is not achieved, and the feel at impact may become too hard.

Condition (2) is that the hardness $H_{r+1}$ at a point located (r+1) mm from the core center and the hardness $H_{r-1}$ at a point located (r−1) mm from the core center satisfy the relationship $10 \leq H_{r+1} - H_{r-1} \leq 35$. In a core that has been set to this condition (2), the hardness rises abruptly at the interface between the center core and the envelope layer, thus achieving a sufficient spin rate-lowering effect on full shots, in addition to which a soft feel at impact and a good durability to cracking are also obtained. The value $H_{r+1} - H_{r-1}$ has a lower limit, expressed in terms of the JIS-C hardness, of preferably at least 12, and more preferably at least 15, and has an upper limit of preferably not more than 30, and more preferably not more than 25. If the hardness difference in this condition (2) is below the lower limit, a sufficient spin rate lowering effect is not obtained, as a result of which the desired distance is not achieved. On the other hand, if the hardness difference is greater than the upper limit, the durability to cracking under repeated impact worsens.

Condition (3) is that the hardness $H_{R-2}$ at a point located 2 mm inside of the core surface and the hardness $H_{r+1}$ at a point located (r+1) mm from the core center satisfy the relationship $0 \leq H_{R-2} - H_{r+1} \leq 7$. In a core that has been set to this condition (3), the hardness slope at sites on the envelope layer is relatively gradual, thus achieving a sufficient spin rate-lowering effect on full shots, in addition to which a soft feel at impact and a good durability to cracking are also obtained. The value $H_{R-2} - H_{r+1}$ has a lower limit, expressed in terms of the JIS-C hardness, of preferably at least 1, and more preferably at least 1.5, and has an upper limit of preferably not more than 5, and more preferably not more than 3. At a hardness difference for this condition (3) greater than the upper limit, a sufficient spin rate lowering effect is not achieved and durability to cracking under repeated impact is not obtained.

Condition (4) is that the difference between the core surface hardness ($H_R$) and the core center hardness ($H_0$) satisfies the relationship $20 \leq H_R - - H_0 \leq 40$. In a core that has been set to this condition (4), the hardness difference for the overall core is sufficiently large, thus achieving a sufficient spin rate-lowering effect on full shots, in addition to which a soft feel at impact and a good durability to cracking are also obtained. The value $H_R - H_0$ has a lower limit, expressed in terms of the JIS-C hardness, of preferably at least 22, and more preferably at least 25, and has an upper limit of preferably not more than 35, and more preferably not more than 30. At a hardness difference for this condition (4) greater than the upper limit, the durability to cracking under repeated impact worsens or a sufficient initial velocity is not achieved, as a result of which the desired distance is not obtained.

The core surface hardness ($H_R$), expressed in terms of JIS-C hardness, is not subject to any particular limitation, but may be set to preferably at least 70, more preferably at least 75, and even more preferably at least 80. The core surface hardness, expressed in terms of JIS-C hardness, has no particular upper limit, although this may be set to preferably not more than 95, more preferably not more than 90, and even more preferably not more than 88. If the surface hardness is too low, the ball rebound may become too low or the spin rate-lowering effect on full shots may be inadequate, as a result of which a good distance may not be achieved. On the other hand, if the surface hardness is too high, the feel at impact may become too hard or the durability to cracking under repeated impact may worsen.

The intermediate layer is described in detail below.

The thickness of the intermediate layer (in cases where the intermediate layer is formed of a plurality of layers, the thickness of each layer) is not subject to any particular limitation, although it is recommended that the intermediate layer be formed so as to be thicker than the subsequently described cover. More specifically, it is recommended that the thickness of the intermediate layer be set to preferably at least 0.5 mm, more preferably at least 0.8 mm, and even more preferably at least 1.0 mm. Although there is no particular upper limit on the intermediate layer thickness, this thickness may be set to preferably not more than 2.5 mm, more preferably not more than 2.0 mm, and even more preferably not more than 1.5 mm. If the thickness of the intermediate layer is larger than the above range or smaller than the thickness of the subsequently described cover, the spin rate-lowering effect on full shots with a driver (W#1) may be inadequate, as a result of which a good distance may not be achieved. Also, if the thickness of the intermediate layer is too small, the durability of the ball to cracking on repeated impact and the low-temperature durability may worsen.

The material hardness of the intermediate layer, although not subject to any particular limitation, may be set to a Shore D value of preferably at least 40, more preferably at least 45, and even more preferably at least 50. Although there is no particular upper limit on this material hardness, the Shore D hardness may be set to preferably not more than 70, more preferably not more than 68, and even more preferably not more than 65. If the hardness of the intermediate layer is too low, the ball may be too receptive to spin on full shots, which may result in a poor distance. On the other hand, if the hardness is too high, the durability to cracking on repeated impact may worsen or the feel of the ball when hit with a putter or on short approach shots may become too hard.

In this invention, letting $T_i$ be the thickness (mm) of the intermediate layer and $H_i$ be the material hardness (Shore D) of the intermediate layer, it is preferable for the golf ball of the invention to satisfy the relationship $80 \leq T_i \times H_i \leq 200$. $T_i \times H_i$ serves as an indicator of the intermediate layer stiffness (in units of mm×Shore D hardness). By using an intermediate layer which satisfies the above range, there can be provided a ball which ensures a high rebound, enables the spin rate on full shots to be reduced and achieves a good distance, and which moreover has an excellent durability to cracking on repeated impact and is capable of enduring harsh conditions of use. The lower limit in the $T_i \times H_i$ value is more preferably at least 100, and even more preferably at least 120. The upper limit in the $T_i \times H_i$ values is more preferably not more than 180, and even more preferably not more than 170.

In cases where the intermediate layer is formed of two or more layers, letting $T_i1$ and $H_i1$ be respectively the thickness (mm) and the material hardness (Shore D) of the first intermediate layer, $T_i2$ and $H_i2$ be respectively the thickness (mm) and the material hardness (Shore D) of the second intermediate layer and $T_iN$ and $H_iN$ be respectively the thickness (mm) and the material hardness (Shore D) of the Nth intermediate layer, the sum of the products of the thickness and the material hardness for the respective layers from the first to the Nth layer $[(T_i1 \times H_i1)+(T_i2 \times H_i2)+ \ldots (T_iN \times H_iN)]$ satisfies the following condition:

$$100 \leq (T_i1 \times H_i1)+(T_i2 \times H_i2)+ \ldots (T_iN \times H_iN) \leq 180.$$

No particular limitation is imposed on the material used to form the intermediate layer, although the use of various types of thermoplastic resins is preferred, with the use of an ionomer resin being more preferred. Commercial products may be used as the ionomer resin. Illustrative examples include sodium-neutralized ionomer resins such as Himilan 1605, Himilan 1601 and AM 7318 (all products of DuPont-Mitsui Polychemicals Co., Ltd.), and Surlyn 8120 (E.I. DuPont de Nemours & Co.); zinc-neutralized ionomer resins such as Himilan 1557, Himilan 1706 and AM 7317 (all products of DuPont-Mitsui Polychemicals Co., Ltd.); and the products available from E.I. DuPont de Nemours & Co. (DuPont) under the trade names HPF 1000, HPF 2000 and HPF AD1027, as well as the experimental material HPF SEP1264-3, also made by DuPont. These may be used singly, or two or more may be used in combination.

These ionomer resins may be used singly or as combinations of two or more types. In the invention, from the standpoint of increasing the rebound of the ball, it is especially preferable to use a combination of a zinc-neutralized ionomer resin with a sodium-neutralized ionomer resin. In such a case, the compounding ratio by weight between the zinc-neutralized ionomer resin and the sodium-neutralized ionomer resin, although not particularly limited, may be set to generally between 25:75 and 75:25, preferably between 35:65 and 65:35, and more preferably between 45:55 and 55:45. At a compounding ratio outside this range, the rebound may become too low, making it impossible to achieve the desired flight performance, the durability to cracking when repeatedly struck at normal temperatures may worsen, and the durability to cracking at low (subzero Celsius) temperatures may worsen.

In cases where the intermediate layer is formed of a plurality of layers, it is preferable for at least a pair of mutually adjoining layers to be made of the same type of thermoplastic resin, particularly ionomer resins.

Various additives may be optionally included in the material used to form the intermediate layer. For example, additives such as pigments, dispersants, antioxidants, light stabilizers, ultraviolet absorbers and mold release agents may be suitably included.

The specific gravity of the intermediate layer, although not particularly limited, may be set to preferably less than 1.20, more preferably not more than 1.1, and even more preferably not more than 1.00. The lower limit in the specific gravity may be set to preferably at least 0.80, and more preferably at least 0.90. At an intermediate layer specific gravity outside the above range, the rebound may become small, as a result of which a good distance may not be achieved, and the durability to cracking under repeated impact may worsen.

The method of forming the intermediate layer is not subject to any particular limitation, although a known method may be employed for this purpose. For example, use may be made of a method that involves injection-molding an Intermediate layer-forming material over the envelope layer, or a method that involves prefabricating a pair of hemispherical half-cups from the intermediate layer-forming material, then enclosing an intermediate product (in this case, the sphere obtained by forming the envelope layer over the center core) within these half-cups and molding under heat and pressure at between 140 and 180° C. for a period of from 2 to 10 minutes.

Next, the cover is described.

The surface hardness of the cover (in this invention, the surface hardness of the ball) $H_b$, expressed in terms of the JIS-C hardness, is preferably at least 60, more preferably at least 70, and even more preferably at least 75. Although there is no particular upper limit on the surface hardness of the cover, the JIS-C hardness may be set to preferably not more than 100, more preferably not more than 95, and even more preferably not more than 90. If the hardness of the cover is too low, the ball may be too receptive to spin on full shots, which may result in a poor distance. On the other hand, if the hardness is too high, the ball may not be receptive to spin on approach shots, as a result of which the controllability may be inadequate even for professional golfers and skilled amateur golfers.

The thickness of the cover is not subject to any particular limitation, although it is recommended that the thickness be set to preferably at least 0.3 mm, more preferably at least 0.5 mm, and even more preferably at least 0.7 mm. There is no particular upper limit on the cover thickness, although the thickness may be set to preferably not more than 1.5 mm, more preferably not more than 1.2 mm, and even more preferably not more than 1.0 mm. If the cover thickness is too large, the rebound of the ball when struck with a driver (W#1) may be inadequate or the spin rate may be too high, as a result of which a good distance may not be obtained. On the other hand, if the cover thickness is too small, the ball may have a poor scuff resistance or may have an inadequate controllability even for professional golfers and skilled amateur golfers.

The cover, although not particularly limited, may be composed primarily of any of various types of known thermoplastic resins or thermoset resins. The use of resins selected from the group consisting of ionomers, polyurethanes and polyureas is especially preferred.

Various additives such as pigments, dispersants, antioxidants, ultraviolet absorbers, ultraviolet stabilizers, mold release agents, plasticizers, and inorganic fillers (e.g., zinc oxide, barium sulfate, titanium dioxide) may be optionally included in the above-described resin composition, i.e., the cover-forming material.

The melt flow rate of the cover-forming material at 210° C. is not subject to any particular limitation. However, to increase the flow properties and manufacturability, the melt flow rate is preferably at least 5 g/10 min, more preferably at least 20 g/10 min, and even more preferably at least 50 g/10 min. If the melt flow rate of the material is too small, the flowability decreases, which may cause eccentricity during injection molding and may also lower the freedom of design in the cover thickness. The melt flow rate is measured in accordance with JIS K 7210-1999.

An example of a method which may be employed to mold the cover involves feeding the cover-forming material to an injection molding machine, and injecting the molten material over the intermediate layer. Although the molding temperature in this case will vary depending on the type of thermoplastic polyurethane or other resin used, the molding temperature is generally in the range of 150 to 250° C.

When forming the cover, although not subject to any particular limitation, to increase adhesion with the intermediate layer, the surface of the intermediate layer (that is, the surface of the sphere following formation of the intermediate layer) may be subjected to some form of pretreatment, such as abrasion treatment, plasma treatment or corona discharge treatment. In addition, it is preferable to apply a primer (adhesive) to the surface of the intermediate layer following abrasion treatment or to add an adhesion reinforcing agent to the cover-forming material.

In the golf ball of the invention, as in conventional golf balls, numerous dimples are formed on the surface of the ball (i.e., the surface of the cover) in order to further increase the aerodynamic properties and extend the distance traveled by the ball. In this case, the number of dimples formed on the ball surface, although not subject to any particular limitation, is preferably at least 280, more preferably at least 300, and even more preferably at least 320. The maximum number of dimples, although not subject to any particular limitation, may be set to preferably not more than 400, more preferably not more than 380, and even more preferably not more than 360. If the number of dimples is larger than the above range, the trajectory of the ball may become low, as a result of which a good distance may not be achieved. On the other hand, if the number of dimples is smaller than the above range, the ball trajectory may become high, as a result of which an increased distance may not be achieved.

The geometric arrangement of the dimples on the ball may be, for example, octahedral or icosahedral. In addition, the dimple shapes may be of one, two or more types suitably selected from among not only circular shapes, but also various polygonal shapes, such as square, hexagonal, pentagonal and triangular shapes, as well as dewdrop shapes and oval shapes. The dimple diameter (in polygonal shapes, the length of the diagonals), although not subject to any particular limitation, is preferably set to from 2.5 to 6.5 mm. In addition, the dimple depth, although not particularly limited, is preferably set to from 0.08 to 0.30 mm.

The value $V_0$, defined as the spatial volume of a dimple below the flat plane circumscribed by the dimple edge, divided by the volume of the cylinder whose base is the flat plane and whose height is the maximum depth of the dimple from the base, although not subject to any particular limitation, may be set to from 0.35 to 0.80 in this invention.

From the standpoint of reducing aerodynamic resistance, the ratio SR of the sum of the individual dimple surface areas, each defined by the flat plane circumscribed by the edge of a dimple, with respect to the surface area of the ball sphere were the ball surface to have no dimples thereon, although not subject to any particular limitation, is preferably set to from 60 to 95%. This ratio SR can be increased by increasing the number of dimples formed, and also by intermingling dimples of a plurality of types of differing diameters or by giving the dimples shapes such that the distances between neighboring dimples (i.e., the widths of the lands) become substantially zero.

The ratio VR of the sum of the spatial volumes of the individual dimples, each formed below the flat plane circumscribed by the edge of a dimple, with respect to the volume of the ball sphere were the ball surface to have no dimples thereon, although not subject to any particular limitation, may be set to from 0.6 to 1%.

In this invention, by setting the above $V_0$. SR and VR values in the foregoing ranges, the aerodynamic resistance is reduced, in addition to which a trajectory enabling a good distance to be achieved is readily obtained, making it possible to improve the flight performance.

The diameter of the golf ball obtained by forming the respective layers described above should conform to the standards for golf balls, and is preferably not less than 42.67 mm. There is no particular upper limit in the golf ball diameter, although the diameter may be set to preferably not more than 44 mm, more preferably not more than 43.8 mm, even more preferably not more than 43.5 mm, and most preferably not more than 43 mm. The weight of the golf ball also is not subject to any particular limitation, although for similar reasons is preferably set in the range of 45.0 to 45.93 g.

In the practice of this invention, to enhance the design and durability of the golf ball, the surface of the ball (i.e., the surface of the cover) may be subjected to various types of treatment, such as surface preparation, stamping and painting.

EXAMPLES

The following Examples and Comparative Examples are provided to illustrate the invention, and are not intended by way of limitation.

Examples 1 to 4, Comparative Examples 1 to 5

The materials used in the Working Examples are shown in Tables 1 and 2. Table 1 shows the rubber compositions, and Table 2 shows the resin compositions. The center cores were formed using materials selected from these tables. In Examples 1 to 4 and Comparative Examples 3 and 4, the center core was formed by injection molding. In Comparative Examples 1, 2 and 5, the center core was formed by preparing a rubber composition, followed by molding and vulcanization at 155° C. for 15 minutes.

Next, an envelope layer was formed using the rubber compositions shown in Table 1. In Examples 1 to 4 and Comparative Examples 1 and 3 to 5, the rubber compositions were prepared using a roll mill, then subjected to primary vulcanization (semi-vulcanization) at 35° C. for 3 minutes to produce a pair of hemispherical half-cups. The center core was then enclosed within the resulting half-cups and secondary vulcanization (complete vulcanization) was carried out at 155° C. for 14 minutes within a mold, thereby forming the envelope layer. In Comparative Example 2, the core was composed of a single layer, and so an envelope layer was not formed.

TABLE 1

| Rubber composition (pbw) | A | B | C | D | E | F | G | H | I | J | K |
|---|---|---|---|---|---|---|---|---|---|---|---|
| Polybutadiene rubber A | 80 | 80 | 80 | | | | 80 | | | | 80 |
| Polybutadiene rubber B | 20 | 20 | 20 | 100 | 100 | 100 | 20 | 100 | 100 | 100 | 20 |
| Zinc acrylate | 30 | 37 | 31 | 39 | 41.4 | 36 | 37 | 36 | 36 | 39 | 37 |
| Organic peroxide A | 1.2 | 1.2 | 0.3 | 1.2 | 1.2 | 1.2 | 1.2 | 1.2 | 1.2 | 1.2 | 1.2 |
| Organic peroxide B | | | 0.3 | | | | | | | | |
| Antioxidant | 0.1 | 0.1 | 0.1 | 0.1 | 0.1 | 0.1 | 0.1 | 0.1 | 0.1 | 0.1 | 0.1 |
| Zinc oxide | 4 | 4 | 4 | 15.7 | 30 | 31.9 | 4 | 31.9 | 26.2 | 13.5 | 4 |
| Barium sulfate | 22.7 | 16.8 | 22.6 | | | | 22.5 | | | | 22.5 |
| Zinc salt of pentachlorothiophenol | | | | 1 | 1 | 1 | 0.1 | 1 | 1 | 1 | 0.1 |

Details on the rubber compositions in Table 1 are given below.

Polybutadiene rubber A: "BRO1" from JSR Corporation

Polybutadiene rubber B: "BR51" from JSR Corporation

Zinc acrylate: Available from Nihon Jyoryu Kogyo Co., Ltd.

Organic peroxide A: "Perhexa C-40" from NOF Corporation; a mixture of 1,1-bis(t-butylperoxy)-cyclohexane and silica Organic peroxide B: "Percumyl D" from NOF Corporation; dicumyl peroxide Antioxidant: "Nocrac 200" from Ouchi Shinko Chemical Industry Co., Ltd.; 2,6-di-t-butyl-4-methylphenol Zinc oxide: Available from Sakai Chemical Co. Ltd.

Barium sulfate: Available as "Precipitated Barium Sulfate 100" from Sakai Chemical Co., Ltd.

TABLE 2

| Resin composition (pbw) | No. 1 | No. 2 | No. 3 | No. 4 | No. 5 | No. 6 |
|---|---|---|---|---|---|---|
| Hytrel 3046 | 50 | | | | | |
| Hytrel 4047 | 50 | | | | | |
| Hytrel SB654 | | 100 | | | | |
| Hytrel 5557 | | | 100 | | | |
| Hytrel 6347 | | | | | | |
| Himilan 1605 | | | | 50 | | |
| Himilan 1706 | | | | 35 | | |
| Himilan 1557 | | | | 15 | | |
| Trimethylolpropane | | | | 1.1 | | |
| HPF 1000 | | | | | 100 | |
| T-8290 | | | | | | 37.5 |
| T-8283 | | | | | | 62.5 |
| Titanium oxide | | | | | | 3.5 |
| Polyethylene wax | | | | | | 1.5 |
| Isocyanate compound | | | | | | 9 |

Details on the resin compositions in Table 2 are given below.

Hytrel: Thermoplastic polyether ester elastomers available from DuPont-Toray Co., Ltd.

Himilan: Ionomers available from DuPont-Mitsui Polychemicals Co., Ltd.

HPF 1000: An ionomer available from E.I. DuPont de Nemours & Co.

T-8290, T-8283: MDI-PTMG type thermoplastic polyurethanes available from DIC Bayer Polymer Ltd. under the trade name "Pandex"

Polyethylene wax: Available under the trade name "Sanwax 161P" from Sanyo Chemical Industries, Ltd.

Isocyanate compound: 4,4'-Diphenylmethane diisocyanate

Figure 2:
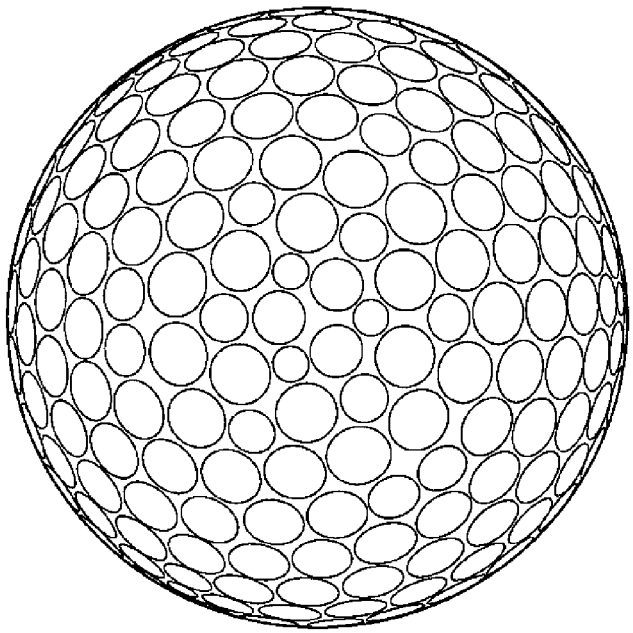
FIG. 2 is a top view showing the dimple pattern formed on the surfaces of the balls in the examples.

An intermediate layer was then formed by injection-molding the resin material shown as No. 4 or No. 5 in Table 2 over the envelope layer formed as described above. In Examples 2 and 3 and Comparative Examples 1 to 5, injection-molding of the resin material was successively carried out twice, thereby forming two intermediate layers (an inner intermediate layer and an outer intermediate layer) over the envelope layer. A cover was then formed by injection-molding the No. 6 resin material over the intermediate layer or layers that had been formed, thereby giving multi-piece solid golf balls with a four- or five-layer structure composed of a core having a two-layer structure that is encased by one or two intermediate layers and, in turn, a cover. Dimples having the configuration shown in FIG. 2 were formed, simultaneous with formation of the cover, on the surfaces of all the balls thus obtained. Table 3 below shows details on the dimples. Table 4 shows details on the golf balls thus produced.

TABLE 3

| No. | Number of dimples | Diameter (mm) | Depth (mm) | $V_0$ | SR (%) | VR (%) |
|---|---|---|---|---|---|---|
| 1 | 12 | 4.6 | 0.15 | 0.47 | 81 | 0.78 |
| 2 | 234 | 4.4 | 0.15 | 0.47 | | |
| 3 | 60 | 3.8 | 0.14 | 0.47 | | |
| 4 | 6 | 3.5 | 0.13 | 0.46 | | |
| 5 | 6 | 3.4 | 0.13 | 0.46 | | |
| 6 | 12 | 2.6 | 0.10 | 0.46 | | |
| Total | 330 | | | | | |

DIMPLE DEFINITIONS

Diameter: Diameter of the flat plane circumscribed by the edge of a dimple.

Depth: Maximum depth of a dimple from the flat plane circumscribed by the edge of the dimple.

$V_0$: Spatial volume of a dimple below the flat plane circumscribed by the edge of the dimple, divided by the volume of the cylinder whose base is the flat plane and whose height is the maximum depth of the dimple from the base.

SR: Sum of individual dimple surface areas, each defined by the flat plane circumscribed by the edge of the dimple, as a percentage of the surface area of a hypothetical sphere were the ball to have no dimples on the surface thereof.

VR: Sum of spatial volumes of individual dimples formed below the flat plane circumscribed by the edge of the dimple, as a percentage of the volume of a hypothetical sphere were the ball to have no dimples on the surface thereof.

The following measurements were carried out on the golf balls obtained. The results are shown in Table 4.

(1) Center Hardness of Core

The core was cut in half (through the center) and measurement was carried out by perpendicularly pressing a JIS-C hardness indenter conforming with JIS K 6301 against the center of the resulting cross-section. These hardnesses were all measured values obtained after holding the core isothermally at 23° C.

(2) Hardness Profiles of Core

The core was cut in half (through the center) and measurement was carried out by perpendicularly pressing a JIS-C hardness indenter conforming with JIS K 6301 against the resulting cross-section at various measurement points thereon. These hardnesses were all measured values obtained after holding the core isothermally at 23° C.

(3) Surface Hardnesses of Core (Envelope Layer), Intermediate Layer and Cover

Measurement was carried out by perpendicularly pressing a JIS-C hardness indenter conforming with JIS K 6301 against the surface of the intermediate product or ball at a stage of production where the layer to be measured has been formed. The surface hardness of the ball (i.e., the surface hardness of the cover) is a value measured at a land area; that is, at a place on the ball surface where no dimple has been formed.

(4) Hardness of Resin Materials

Each resin material was molded into sheets having a thickness of 2 mm and held for two weeks at 23° C., following which the sheets were stacked to a thickness of at least 6 mm and the hardness was measured with a type D durometer conforming to ASTM D2240-95.

(5) Stiffness Index of Intermediate Layer

The stiffness index is the product of the intermediate layer thickness $T_i$ (mm) multiplied by the intermediate layer hardness $H_i$ (Shore D); that is, $T_i \times H_i$. In cases where there are two intermediate layers—an inner intermediate layer and an outer intermediate layer, letting $T_i1$ and $H_i1$ be, respectively, the thickness and material hardness of the inner intermediate layer, and letting $T_i2$ and $H_i2$ be, respectively, the thickness and material hardness of the outer intermediate layer, the stiffness index refers to the value $(T_i1 \times H_i1)+(T_i2 \times H_i2)$.

TABLE 4

| | | | Example | | | | Comparative Example | | | | |
|---|---|---|---|---|---|---|---|---|---|---|---|
| | | | 1 | 2 | 3 | 4 | 1 | 2 | 3 | 4 | 5 |
| Core | Center core | Material | No. 1 | No. 1 | No. 1 | No. 1 | A | B | No. 2 | No. 3 | C |
| | | Radius r (mm) | 11.5 | 11.5 | 11.5 | 11.5 | 11.5 | 17.7 | 11.5 | 11.5 | 11.5 |
| | | Weight (g) | 7.0 | 7.0 | 7.0 | 7.0 | 7.6 | 27.4 | 7.1 | 7.6 | 7.6 |
| | | Specific gravity | 1.10 | 1.10 | 1.10 | 1.10 | 1.20 | 1.18 | 1.11 | 1.19 | 1.20 |
| | | Material hardness (Shore D) | 34 | 34 | 34 | 34 | — | — | 20 | 55 | — |
| | | Core hardness profile (JIS-C) | | | | | | | | | |
| | | Center hardness ($H_0$) (JIS-C) | 57 | 57 | 57 | 57 | 56 | 64 | 37 | 83 | 61 |
| | | Hardness 2 mm from center | 57 | 57 | 57 | 57 | 57 | — | 37 | 83 | 62 |
| | | Hardness 4 mm from center | 57 | 57 | 57 | 57 | 58 | — | 37 | 83 | 63 |
| | | Hardness 6 mm from center | 57 | 57 | 57 | 57 | 59 | — | 37 | 83 | 64 |
| | | Hardness 8 mm from center | 57 | 57 | 57 | 57 | 60 | — | 37 | 83 | 65 |
| | | Hardness 10 mm from center | 57 | 57 | 57 | 57 | 63 | — | 37 | 83 | 66 |
| | | Hardness 2 mm inside surface (Hr − 2) | 57 | 57 | 57 | 57 | 62 | — | 37 | 83 | 66 |
| | | Hardness 1 mm inside surface (Hr − 1) | 57 | 57 | 57 | 57 | 66 | — | 37 | 83 | 66 |
| | Envelope layer | Material | D | E | F | J | G | | H | I | K |
| | | Thickness (mm) | 7.8 | 6.2 | 6.2 | 8.1 | 5.2 | | 6.2 | 6.2 | 6.2 |
| | | Specific gravity | 1.17 | 1.25 | 1.25 | 1.15 | 1.21 | | 1.25 | 1.22 | 1.21 |
| | | Hardness 1 mm from inside boundary ($H_{r+1}$) | 78 | 80 | 76 | 78 | 72 | | 80 | 80 | 72 |
| | | Hardness 2 mm from surface ($H_{R-2}$) | 80 | 82 | 77 | 80 | 80 | | 82 | 82 | 80 |
| | | Surface hardness ($H_R$) (JIS-C) | 87 | 89 | 83 | 87 | 87 | 87 | 89 | 89 | 87 |

TABLE 4-continued

| | | | Example | | | | Comparative Example | | | | |
|---|---|---|---|---|---|---|---|---|---|---|---|
| | | | 1 | 2 | 3 | 4 | 1 | 2 | 3 | 4 | 5 |
| | Envelope layer-encased sphere | Diameter (mm) | 38.6 | 35.4 | 35.4 | 39.2 | 35.4 | — | 35.4 | 35.4 | 35.4 |
| | | Weight (g) | 34.4 | 28.1 | 28.1 | 35.8 | 28.2 | — | 28.2 | 28.2 | 28.2 |
| | Core hardness relationships (JIS-C) | $H_{r+1} - H_{r-1}$ | 21 | 23 | 19 | 21 | 6 | — | 43 | -3 | 6 |
| | | $R_{R-2} - H_{r+1}$ | 2 | 2 | 1 | 2 | 8 | — | 2 | 2 | 8 |
| | | $H_R - H_0$ | 30 | 32 | 26 | 30 | 31 | 23 | 52 | 6 | 26 |
| Intermediate layer | Inner intermediate layer | Material | No. 4 | No. 5 | No. 5 | No. 4 | No. 5 | No. 5 | No. 5 | No. 5 | No. 5 |
| | | Thickness (mm) | 1.3 | 1.7 | 1.7 | 1.0 | 1.7 | 1.7 | 1.7 | 1.7 | 1.7 |
| | | Specific gravity | 0.95 | 0.95 | 0.95 | 0.95 | 0.95 | 0.95 | 0.95 | 0.95 | 0.95 |
| | | Material hardness (Shore D) | 62 | 52 | 52 | 62 | 52 | 52 | 52 | 52 | 52 |
| | Inner intermediate layer-encased sphere | Diameter (mm) | 41.2 | 38.8 | 38.8 | 41.2 | 38.8 | 38.8 | 38.8 | 38.8 | 38.8 |
| | | Weight (g) | 40.6 | 35.1 | 35.1 | 40.6 | 35.1 | 35.1 | 35.1 | 35.1 | 35.1 |
| | Outer intermediate layer | Material | | No. 4 | No. 4 | | No. 4 | No. 4 | No. 4 | No. 4 | No. 4 |
| | | Thickness (mm) | | 1.2 | 1.2 | | 1.2 | 1.2 | 1.2 | 1.2 | 1.2 |
| | | Specific gravity | | 0.95 | 0.95 | | 0.95 | 0.95 | 0.95 | 0.95 | 0.95 |
| | | Material hardness (Shore D) | | 62 | 62 | | 62 | 62 | 62 | 62 | 62 |
| | Outer intermediate layer-encased sphere | Diameter (mm) | | 41.2 | 41.2 | | 41.2 | 41.2 | 41.2 | 41.2 | 41.2 |
| | | Weight (g) | | 40.6 | 40.6 | | 40.6 | 40.6 | 40.6 | 40.6 | 40.6 |
| | | Stiffness index | 80.6 | 162.8 | 162.8 | 62.0 | 162.8 | 162.8 | 162.8 | 162.8 | 162.8 |
| Cover | | Material | No. 6 | No. 6 | No. 6 | No. 6 | No. 6 | No. 6 | No. 6 | No. 6 | No. 6 |
| | | Thickness (mm) | 0.8 | 0.8 | 0.8 | 0.8 | 0.8 | 0.8 | 0.8 | 0.8 | 0.8 |
| | | Specific gravity | 1.12 | 1.12 | 1.12 | 1.12 | 1.12 | 1.12 | 1.12 | 1.12 | 1.12 |
| Ball | | Diameter (mm) | 42.7 | 42.7 | 42.7 | 42.7 | 42.7 | 42.7 | 42.7 | 42.7 | 42.7 |
| | | Weight (g) | 45.5 | 45.5 | 45.5 | 45.5 | 45.5 | 45.5 | 45.5 | 45.5 | 45.5 |
| | | Surface hardness (JIS-C) | 87 | 87 | 87 | 87 | 87 | 87 | 87 | 87 | 87 |

Next, the flight performance, spin performance on approach shots, and durability to cracking of the golf balls according to Examples 1 to 4 and Comparative Examples 1 to 5 shown in Table 4 above were measured and evaluated as described below. The results are presented in Table 5.

Flight Performance

A driver (W#1) was mounted on a golf swing robot, and the spin rate, carry and total distance when the ball was struck at a head speed of 45 m/s were measured. The club used was a TourStage X-Drive 707 (2012 model; loft angle, 9.5°) manufactured by Bridgestone Sports Co., Ltd. The rating criteria in the table were as follows.

Good: Total distance was 230 m or more

NG: Total distance was less than 230 m

Spin Performance on Approach Shots

A sand wedge (SW) was mounted on a golf swing robot, and the spin rate when the ball was struck at a head speed of 20 m/s was measured. The club used was a TourStage X-WEDGE (loft angle, 56°) manufactured by Bridgestone Sports Co., Ltd. The rating criteria in the table were as follows.

Good: Spin rate on approach shots was 6,000 rpm or more

NG: Spin rate on approach shots was less than 6,000 rpm

Durability to Cracking

The ball was repeatedly hit at a head speed of 45 m/s with a driver (W#1) mounted on a golf swing robot, and the number of shots that had been taken when the ball began to crack was determined. The club used was a TourStage X-Drive 707 (2012 model; loft angle, 9.5°) manufactured by Bridgestone Sports Co., Ltd. Table 5 shows the results obtained by calculating durability indices for the respective Examples and Comparative Examples, relative to an arbitrary index of 100 for the average number of shots taken with the balls (n=5) in Example 1 when cracking began, and rating the durability to cracking according to the following criteria.

Good: Durability index was 90 or more

Fair: Durability index was at least 80 but less than 90

NG: Durability index was less than 80

TABLE 5

| | | | Example | | | | Comparative Example | | | | |
|---|---|---|---|---|---|---|---|---|---|---|---|
| | | | 1 | 2 | 3 | 4 | 1 | 2 | 3 | 4 | 5 |
| Flight performance | W#1 HS, 45 m/s | Spin rate (rpm) | 2,680 | 2,700 | 2,600 | 2,670 | 2,750 | 2,830 | 2,580 | 2,960 | 2,730 |
| | | Carry (m) | 215.4 | 216.1 | 214.1 | 215.2 | 214.9 | 214.7 | 215.7 | 213.3 | 215.1 |
| | | Total distance (m) | 231.5 | 232.1 | 231 | 231.4 | 228.9 | 228.2 | 230.4 | 227.1 | 229.3 |
| | | Rating | good | good | good | good | NG | NG | good | NG | NG |
| Spin performance on approach shots | SW HS, 20 m/s | Spin rate (rpm) | 6,270 | 6,300 | 6,180 | 6,290 | 6,320 | 6,340 | 6,230 | 6,400 | 6,350 |
| | | Rating | good | good | good | good | good | good | good | good | good |
| Durability to repeated impact | | | good | good | good | fair | good | good | NG | good | good |

The results in Table 5 show that the Comparative Examples were inferior to the Working Examples of the invention in the following ways.

In Comparative Example 1, the hardness difference between the core center and points located (r−2) mm from the core center was large. As a result, the spin rate on shots with a driver (W#1) was high and a good distance was not obtained.

In Comparative Example 2, the core consisted of a single layer made of a rubber composition. As a result, the spin rate on shots with a driver (W#1) was high and a good distance was not obtained.

In Comparative Example 3, the hardness difference ($H_{r+1}-H_{r-1}$) between the hardness at a point located (r+1) mm from the core center and the hardness $H_{r-1}$ at a point located (r−1) mm from the core center was large. As a result, the durability to cracking under repeated impact was poor.

In Comparative Example 4, the hardness difference ($H_R-H_0$) between the core surface hardness ($H_R$) and the core center hardness ($H_0$) was small. As a result, the spin rate on shots with a driver (W#1) was large and a good distance was not obtained.

In Comparative Example 5, the hardness difference between the core center and a point located (r−2) mm from the core center was large. As a result, the spin rate on shots with a driver (W#1) was high and a good distance was not obtained.

Japanese Patent Application No. 2014-129048 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a core formed of a center core encased by an envelope layer, a cover having a plurality of dimples on a surface thereof, and one or more intermediate layer disposed between the core and the cover, wherein the center core is composed primarily of a thermoplastic polyester elastomer and the envelope layer is composed primarily of a rubber composition, the radius r (mm) of the center core satisfies the condition $5 \le r \le 15$, and the cross-sectional hardness (JIS-C hardness) of the core satisfies the following conditions:

(1) the hardness difference between the core center and any point located up to (r−2) mm from the core center is 2 or less;

(2) the hardness $H_{r+1}$ at a point located (r+1) mm from the core center and the hardness $H_{r-1}$ at a point located (r−1) mm from the core center satisfy the relationship $10 \le H_{r+1}-H_{r-1} \le 35$;

(3) the hardness $H_{R-2}$ at a point located 2 mm inside of the core surface and the hardness $H_{r+1}$ at a point located (r+1) mm from the core center satisfy the relationship $1 \le H_{R-2}-H_{r+1} \le 7$;

(4) the difference between the core surface hardness ($H_R$) and the core center hardness ($H_0$) satisfies the relationship $22 \le H_R-H_0 \le 40$, and wherein the core center hardness ($H_0$) satisfies the condition $52 \le H_0 \le 70$.

2. The multi-piece solid golf ball according to claim 1 which, letting $T_i$ be the thickness (mm) of the intermediate layer and $H_i$ be the material hardness (Shore D) of the intermediate layer, satisfies the relationship $80 \le T_i \times H_i \le 200$.

3. The multi-piece solid golf ball according to claim 1, wherein the intermediate layer is formed of a plurality of N layers and, letting $T_i1$ and $H_i1$ be respectively the thickness (mm) and the material hardness (Shore D) of the first intermediate layer, $T_i2$ and $H_i2$ be respectively the thickness (mm) and the material hardness (Shore D) of the second intermediate layer and $T_iN$ and $H_iN$ be respectively the thickness (mm) and the material hardness (Shore D) of the Nth intermediate layer, the sum of the products of the thickness and the material hardness for the respective layers from the first to the Nth layer satisfies the following condition:

$$100 \le (T_i1 \times H_i1)+(T_i2 \times H_i2)+\ldots(T_iN \times H_iN) \le 180.$$

4. The multi-piece solid golf ball according to claim 1, wherein the intermediate layer is composed primarily of a thermoplastic resin.

5. The multi-piece solid golf ball according to claim 4, wherein the intermediate layer is formed of a plurality of layers, of which at least a pair of mutually adjoining layers are made of the same type of thermoplastic resin.

6. The multi-piece solid golf ball according to claim 4, wherein the thermoplastic resin of which the intermediate layer is primarily composed is an ionomer.

7. The multi-piece solid golf ball according to claim 1, wherein the cover is composed primarily of a thermoplastic resin or a thermoset resin.

8. The multi-piece solid golf ball according to claim 7, wherein the cover is composed primarily of a material selected from the group consisting of ionomers, polyurethanes and polyureas.

9. The multi-piece solid golf ball according to claim 1 which, letting the surface hardness (JIS-C hardness) of the ball be $H_b$, satisfies the condition $60 \le H_b \le 100$.

10. The multi-piece solid golf ball according to claim 1, wherein the thermoplastic polyester elastomer of the center core is a polyether ester elastomer.

11. The multi-piece solid golf ball according to claim 1, wherein the center core has a material hardness expressed in terms of Shore D hardness of from 27 to 50.

12. The multi-piece solid golf ball according to claim 1, wherein the center core has a material hardness expressed in terms of Shore D hardness of from 27 to 40.

13. The multi-piece solid golf ball according to claim 1, wherein the rubber composition of the envelope layer include an organo sulfur compound.

14. The multi-piece solid golf ball according to claim 13, wherein the organosulfur compound is one or more halogenated thiophenols and metal salts thereof selected from the group consisting of pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol and the zinc salt of p-chlorothiophenol.

15. The multi-piece solid golf ball according to claim 1, wherein the lower limit of the core center hardness ($H_0$) is 55.

16. The multi-piece solid golf ball according to claim 1, wherein the hardness $H_{r+1}$ at a point located (r+1) mm from the core center and the hardness $H_{r-1}$ at a point located (r−1) mm from the core center satisfy the relationship $21 \le H_{r+1}-H_{r-1} \le 35$.

* * * * *